US008568281B2

(12) United States Patent
Beaulieu et al.

(10) Patent No.: US 8,568,281 B2
(45) **Date of Patent: *Oct. 29, 2013**

(54) STRENGTH TRAINING WORKOUT BENCH

(75) Inventors: Stephen M. Beaulieu, Valencia, CA (US); Ellen Como, Valencia, CA (US); Tony Greasley, Valencia, CA (US); Michele Beaulieu, Valencia, CA (US)

(73) Assignee: Core Bench Fitness, Valencia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/142,643

(22) PCT Filed: Jun. 15, 2010

(86) PCT No.: PCT/US2010/038731

§ 371 (c)(1),
(2), (4) Date: Aug. 16, 2011

(87) PCT Pub. No.: WO2010/148031

PCT Pub. Date: Dec. 23, 2010

(65) Prior Publication Data

US 2011/0306480 A1 Dec. 15, 2011

Related U.S. Application Data

(63) Continuation-in-part of application No. 12/456,275, filed on Jun. 15, 2009, now Pat. No. 7,833,144.

(51) Int. Cl.
*A63B 26/00* (2006.01)

(52) U.S. Cl.
USPC ..... 482/142

(58) Field of Classification Search
USPC ..... 482/1–148
See application file for complete search history.

(56) References Cited

U.S. PATENT DOCUMENTS

| | | | | |
|---|---|---|---|---|
| 3,421,163 | A | | 1/1969 | Stoughton |
| 4,422,634 | A | | 12/1983 | Hopkins |
| 4,480,828 | A | * | 11/1984 | Kifferstein ..... 482/74 |
| 4,770,409 | A | * | 9/1988 | Wallisch ..... 482/45 |
| 4,864,941 | A | * | 9/1989 | Goulter ..... 108/132 |
| 5,048,823 | A | | 9/1991 | Bean |
| 5,369,828 | A | | 12/1994 | Graebe |

(Continued)

FOREIGN PATENT DOCUMENTS

| | | |
|---|---|---|
| WO | 2007067058 A1 | 6/2007 |
| WO | WO2007/067058 | 6/2007 |

OTHER PUBLICATIONS

International Search Report dated Jan. 26, 2011, application PCT/US2010/038731.

(Continued)

*Primary Examiner* — Stephen Crow
(74) *Attorney, Agent, or Firm* — Jeffrey G. Sheldon; Sheldon Mak & Anderson

(57) ABSTRACT

A rectangular workout bench with removable legs for use directly on the floor or raised on legs 12, 13, 108 has an inflatable flexible air filled plastic material cushion 2 work out area allowing a person to lay on for physical therapy, strength training and balance. The rectangular shape allows spine and neck support while the instability of the air filled cushion 2 allows muscles to activate. Beginners use the workout cushion 2 directly on the floor and advanced workouts are on the elevated bench with accessible footrests.

16 Claims, 9 Drawing Sheets

(56) References Cited

U.S. PATENT DOCUMENTS

| | | | | |
|---|---|---|---|---|
| 5,403,008 | A * | 4/1995 | Mainiero | 473/201 |
| 5,665,038 | A * | 9/1997 | Miller | 482/104 |
| 5,722,922 | A * | 3/1998 | Watterson et al. | 482/136 |
| 5,778,953 | A * | 7/1998 | Braddock | 144/286.1 |
| 5,913,758 | A | 6/1999 | Nunez | |
| 6,322,484 | B1 | 11/2001 | Muller | |
| 6,422,983 | B1 | 7/2002 | Weck | |
| 6,554,753 | B1 | 4/2003 | Weck et al. | |
| 6,575,885 | B1 * | 6/2003 | Weck et al. | 482/147 |
| 6,899,662 | B2 | 5/2005 | Gamble | |
| 7,074,166 | B2 | 7/2006 | Weitzman | |
| 7,204,790 | B2 * | 4/2007 | Sleamaker | 482/96 |
| 7,344,488 | B2 | 3/2008 | Weck et al. | |
| 7,392,559 | B2 | 7/2008 | Peterson | |
| 7,494,446 | B2 | 2/2009 | Weck et al. | |
| 7,533,485 | B2 * | 5/2009 | Nyland | 43/25 |
| 7,833,144 | B1 * | 11/2010 | Como et al. | 482/142 |
| 7,883,144 | B2 | 2/2011 | Brunner | |
| 2004/0102293 | A1 | 5/2004 | Mostardi | |
| 2005/0052058 | A1 * | 3/2005 | Nyo et al. | 297/159.1 |
| 2006/0135330 | A1 * | 6/2006 | Clark et al. | 482/139 |
| 2007/0087902 | A1 | 4/2007 | Penat et al. | |
| 2007/0207901 | A1 | 9/2007 | Traub | |
| 2007/0275834 | A1 * | 11/2007 | Reilly | 482/91 |
| 2008/0084104 | A1 * | 4/2008 | VanHorn | 297/452.4 |
| 2010/0179037 | A1 * | 7/2010 | Reilly | 482/139 |

OTHER PUBLICATIONS

Office Action dated Sep. 28, 2009, U.S. Appl. No. 12/456,275, filed Jun. 15, 2009 now issued U.S. Patent No. 7,833,144.
Office Action dated Mar. 18, 2010, U.S. Appl. No. 12/456,275, filed Jun. 15, 2009 now issued U.S. Patent No. 7,833,144.
Office Action dated Jun. 28, 2010, U.S. Appl. No. 12/456,275, filed Jun. 15, 2009 now issued U.S. Patent No. 7,833,144.
Office Action dated Jul. 29, 2010, U.S. Appl. No. 12/456,275, filed Jun. 15, 2009 now issued U.S. Patent No. 7,833,144.
Office Action dated Sep. 28, 2009, U.S. Appl. No. 12/4546,275 filed Jun. 15, 2009 now issued U.S. Patent No. 7,833,144.
Office Action dated Mar. 18, 2010, U.S. Appl. No. 12/4546,275 filed Jun. 15, 2009 now issued U.S. Patent No. 7,833,144.
Office Action dated Jun. 28, 2010, U.S. Appl. No. 12/4546,275 filed Jun. 15, 2009 now issued U.S. Patent No. 7,833,144.
Office Action dated Jul. 29, 2010, U.S. Appl. No. 12/4546,275 filed Jun. 15, 2009 now issued U.S. Patent No. 7,833,144.

* cited by examiner

STRENGTH TRAINING WORKOUT BENCH

CROSS-REFERENCE TO RELATED APPLICATIONS

The present application is a continuation in part of U.S. patent application Ser. No. 12/456,275, titled "Strength Training Workout Bench," filed Jun. 15, 2009 now U.S. Pat. No. 7,833,144, the contents of which are incorporated in this disclosure by reference in their entirety.

BACKGROUND

This invention relates to a person's strength training and balance while supported by a body length flexible cushion. The cushion instability allows movement and muscle activation while supporting the spine and neck. Footrest protrusions provide support and stability while working out.

Physical training and work out is a part of daily life for thousands of people over the world. A need for a work out medium which will support a body length when lying down and still allow movement of the body muscles is evident. Weck and Cotter U.S. Pat. No. 6,422,983 shows us the very popular spherical shaped Bosu ball design which provides a flexible single point support platform for stability training. The potential of misuse is great since only a local support of the body is achieved.

The proposed rectangular strength training work out bench overcomes this potential problem by supporting the body over its length allowing very active training in both the floor position for beginners and the elevated bench position for advanced work out.

SUMMARY

In accordance with the present invention an object of the invention is to provide a workout platform that supports the entire weight of a person while allowing the movement of the body muscles with the head, neck and spine held in suspension as movement is achieved. The legs of the preferred bench embodiment are removable allowing a safe floor platform for the beginner to workout on while the elevated configuration provides increased freedom of movement for the user while being stabilized using the foot rest protrusions provided on the far end of the rectangular cushioned platform.

In a preferred version of the invention there is a rectangular support and a base for holding the support above the ground, with a single, flexible rectangular gas filled cushion secured to the support. The cushion comprises a body with a dome-shaped upper surface, a bottom surface a length, and a longitudinal axis. The apex of the upper surface of the body extends along the length of the body parallel the longitudinal axis of the support for creating instability when exercising. A retainer secures the cushion peripheral rim to the support. The cushion has a peripheral rim along at least a portion of the edge of the bottom surface of the body.

Preferably the support is fastened to the base by hand releasable fasteners that can be released without tools for using the cushion, support, and retainer combination without the base.

Preferably the support provides space below the cushion for expansion of the cushion into the space when pressure is applied to the top surface of the cushion body.

The support has a head section and a foot section. Preferably the retainer comprises a foot support on each side of the apparatus at the foot section. Preferably there is a hand grip on each side of the apparatus at the head section.

DRAWINGS

These and other features, aspects, and advantages of the present invention will become better understood with regard to the following description, dependent claims, and accompanying drawings, where:

FIG. 6 is a top perspective view of an apparatus having features of the present invention;

DESCRIPTION

Figure 1:
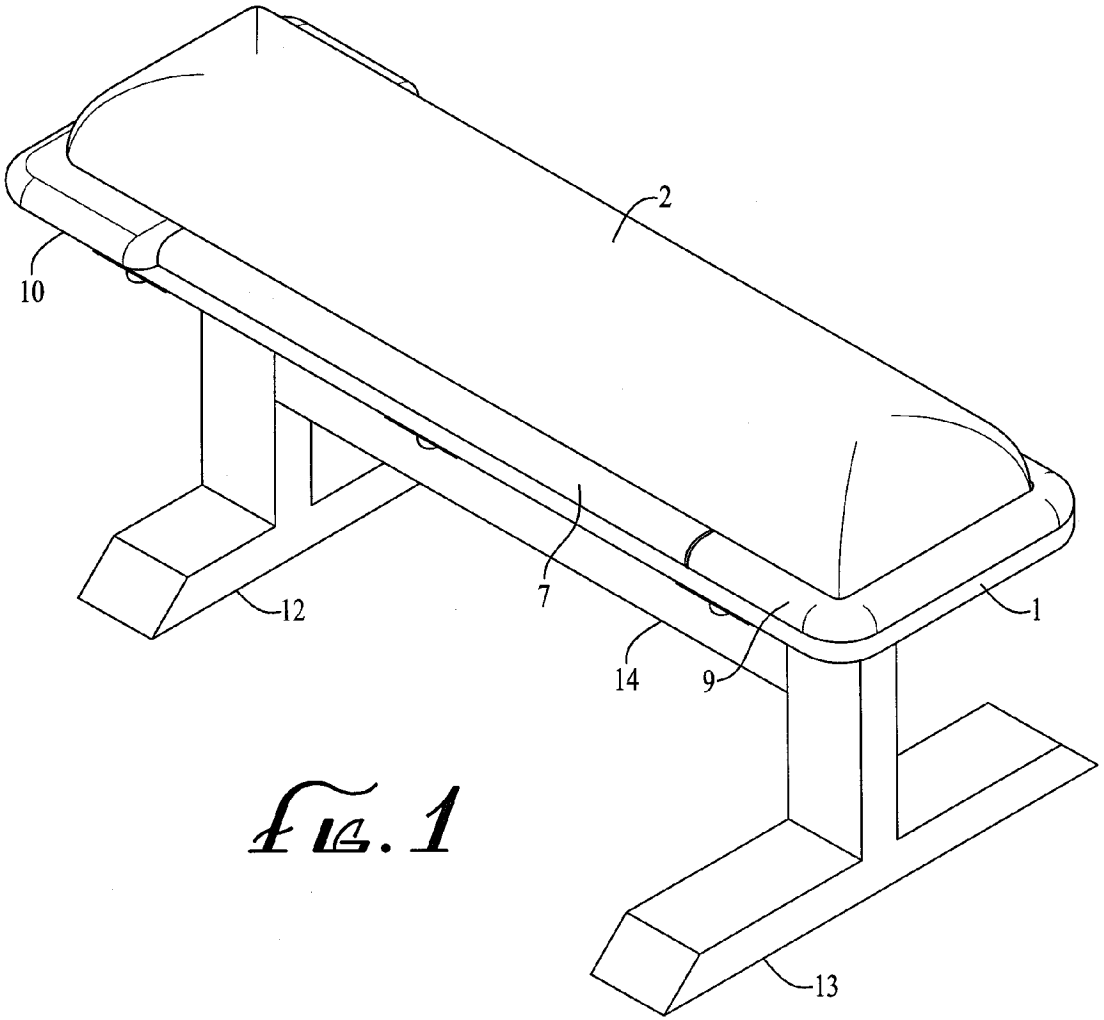
FIG. 1 shows a perspective view of the strength training work out bench invention in the advanced user elevated position with the legs attached.
Figure 3:
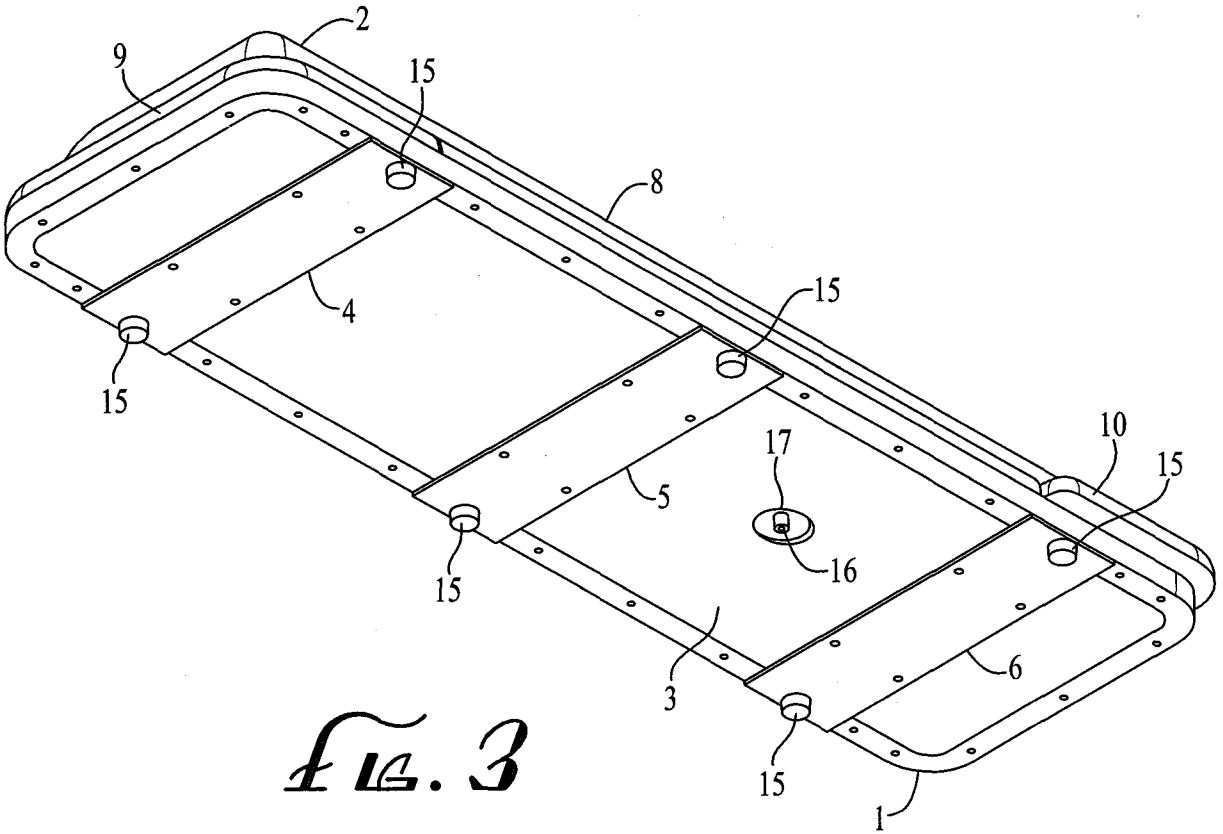
FIG. 3 shows the bottom perspective view of the workout bench with access to the flexible cushion air fill port as well as the cross braces for mounting the legs.
Figure 4:
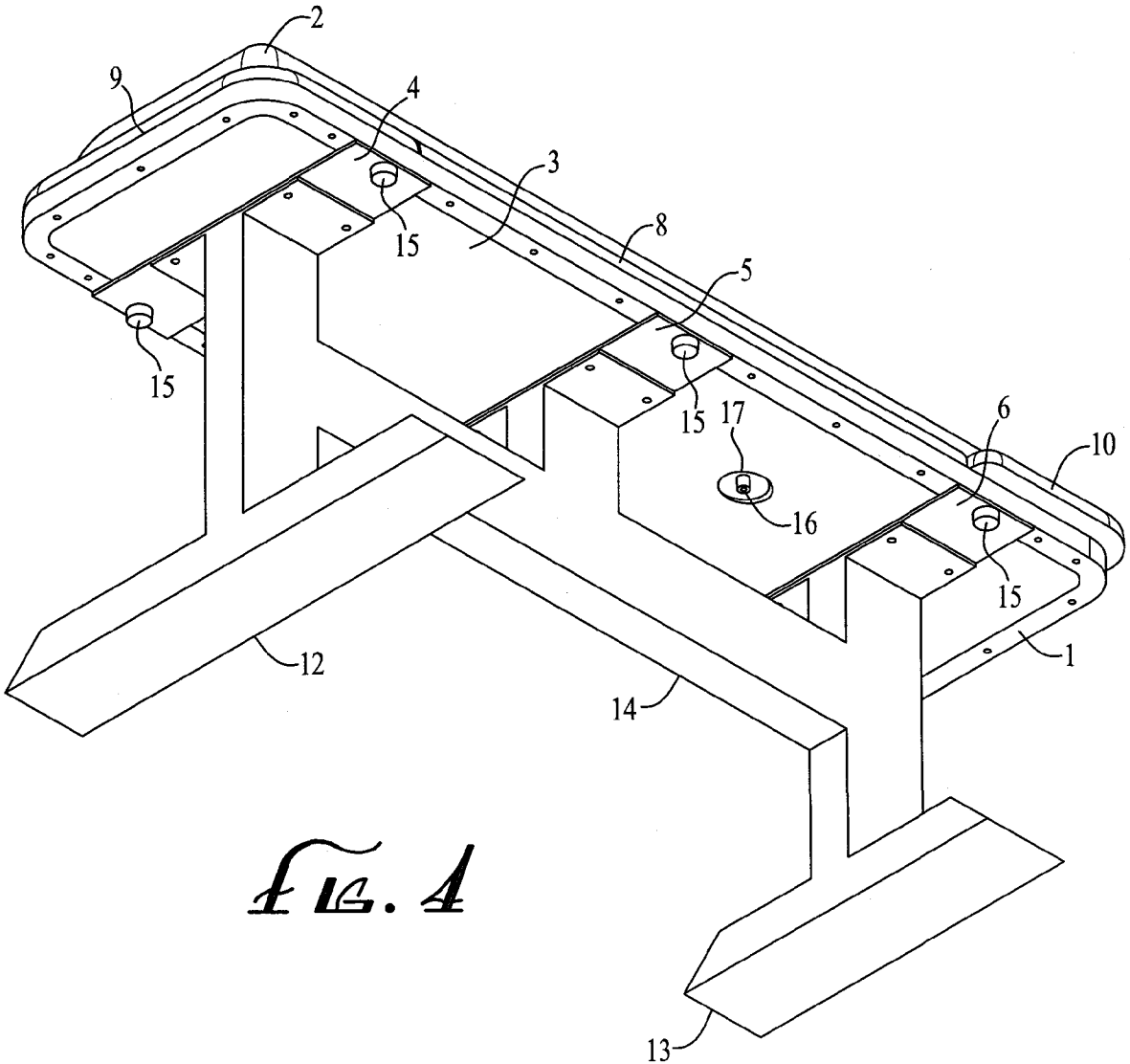
FIG. 4 shows the bottom perspective view of the workout bench with the legs installed as well as access to the cushion air fill port.

Reference to FIG. 1 shows a work out bench having a rectangular steel frame 1 surrounding a flexible air filled plastic cushion 2 supported by a base board 3 shown in FIGS. 3 and 4 resting on cross brace 4, 5 and 6 attached to the rectangular steel frame 1.

Figure 5:
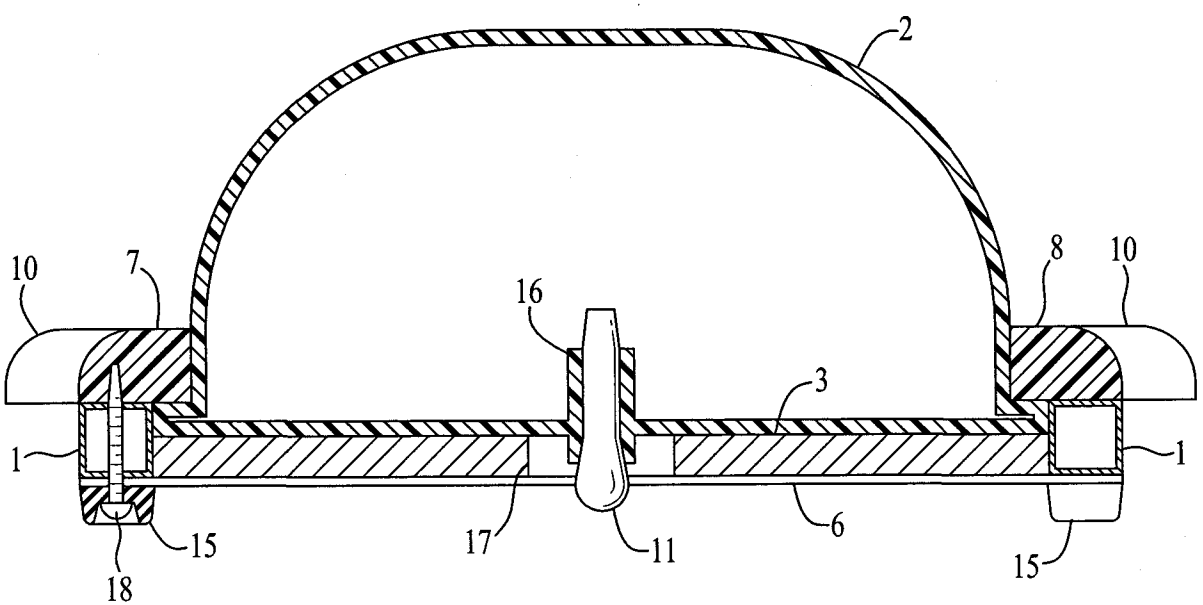
FIG. 5 is a cross sectional view of the air filled cushion and the method by which it is clamped to the work out bench platform.

With reference to FIG. 5 the air filled flexible cushion 2 resting on the base board 3 is clamped in place by molded plastic retainers 7, 8, 9 and 10 which are bolted to the steel frame 1 with self threading screws 18 into the plastic retainers 7, 8, 9 and 10. The base board 3 and plastic retainers 7, 8, 9 and 10 capture the surrounding edge of the air filled flexible cushion 2 as shown in FIG. 5.

The plastic retainer 10 (see FIG. 1) on the foot end of the workout bench is wide with a step in width from the adjacent plastic retainers 7 and 8 providing a resting place for your feet when working out on the work out bench.

Figure 2:
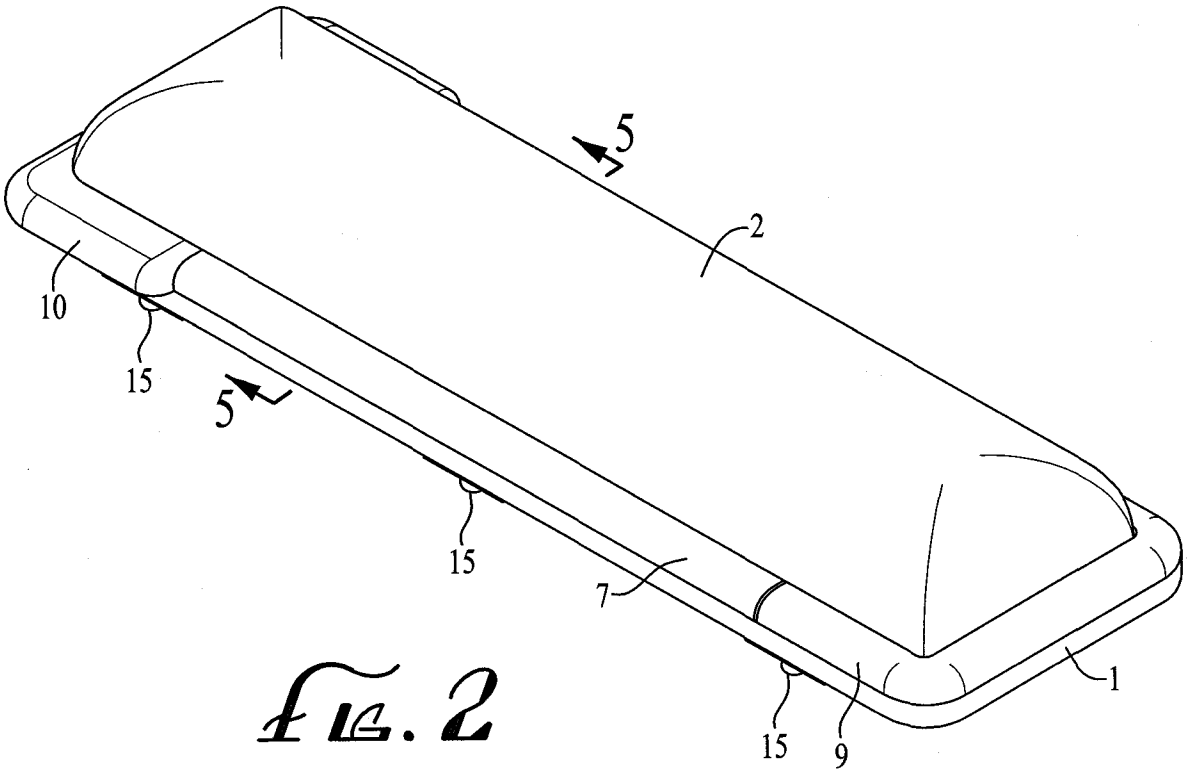
FIG. 2 shows a perspective view of the strength training workout bench invention with the legs removed. The strength training work out bench is placed directly on the floor.

The elevated bench assembly shown in FIG. 1 rests on legs 12, 13 and cross brace 14 shown in FIGS. 1 and 4. The legs are attached by removable means to cross brace 4, 5 and 6 shown in FIG. 3. Removal of the legs 12, 13 and cross brace 14 allows the work out bench to be placed directly on the floor resting on rubber bumper 15 shown in FIGS. 3 and 4 to be used as a beginner's bench configuration as seen in FIG. 2.

FIG. 5 shows the flexible air filled cushion 2 resting on the base 3 surrounded by the rectangular steel frame 1. The edge of the flexible air filled cushion 2 is molded integral to the cushion and provides a semi rigid periphery to the flexible air filled cushion such that when clamped between the base 3 and the plastic retainers 7, 8, 9 and 10 surrounded by the rectangular steel frame the flexible air filled cushion expands upwards when air pressure is applied through port 16 filling the molded rectangular shape of the cushion as required to support the full weight of a person exercising on the work out bench. Fill port 16 shown in FIGS. 3, 4 and 5 is centrally located in the lower surface of the air filled plastic cushion such as to be accessible from the bottom of the work out bench through an access hole 17 located in the base 3. Proper air filling of the cushion 2 provides support for various weight individuals. Air filling can be adjusted by removing the filler plug 11 shown in FIG. 5 and adding or releasing air pressure to the cushion 2 and then replacing the filler plug 11 when the cushion 2 is properly inflated. Because of the large surface area of the flexible plastic cushion relative to an individual's size, pressure to support the individual laying down on the cushion requires only a low level of air pressure dependant on the weight of the individual using the workout bench.

Features of this invention include:

A. A rectangular bench like device for physical therapy, strength training and balance. An air filled rectangular shaped flexible cushion allows muscles to activate while supporting the neck and spine.

B. An air inflatable flexible rectangular cushion supported on a bench like structure and anchored securely to the bench periphery.

C. A rectangular bench like structure which supports an air filled cushion of sufficient length to support an individual laying down on the bench.

D. A rectangular bench like structure with access to an air fill port on the resting surface of the cushion.

E. A rectangular bench like structure with foot rest protrusions on each side adjacent to and below the air filled cushion on the foot end of the bench.

F. A rectangular bench like structure of sufficient height and stability to allow exercise from a prone position laying on the bench cushion with foot clearance on the foot end and a wide stance on the head end for bench stability.

G. Removable legs.

H. A rectangular bench device with legs removed placed directly on the floor for beginner training work out.

A preferred version of an exercise apparatus 102 is shown in FIGS. 6-9, where the same reference numbers used for FIGS. 1-5 are used for like features. The apparatus comprises generally a rectangular support 104 and a base 106 for holding the support 104 above ground. The base 106 comprises a pair of legs 108 connected by a cross brace 110, each leg having a foot 112 that sits on the ground, and an upper header 114. An upwardly extending brace 118 extends from the cross brace 110 to the underside of the support 104 and has a header 120. The headers 114, 120 are secured to the bottom of the generally rectangular support 104 by quick release hand release fasteners 122 received in fastener receiving pockets 124. By "hand release fasteners" there is meant fasteners that can be released without tools. Optionally, one or both of the legs 108 can be provided with wheels (not shown) for moving the exercise apparatus 102.

The flexible, rectangular gas filled cushion 2 is secured to the upper surface of the support 104 by a retainer 130. The cushion 2 is preferably formed from a single, integral material. It can be made of a burst resistant material such as polyvinyl chloride, or elastomeric resin.

Figure 9:
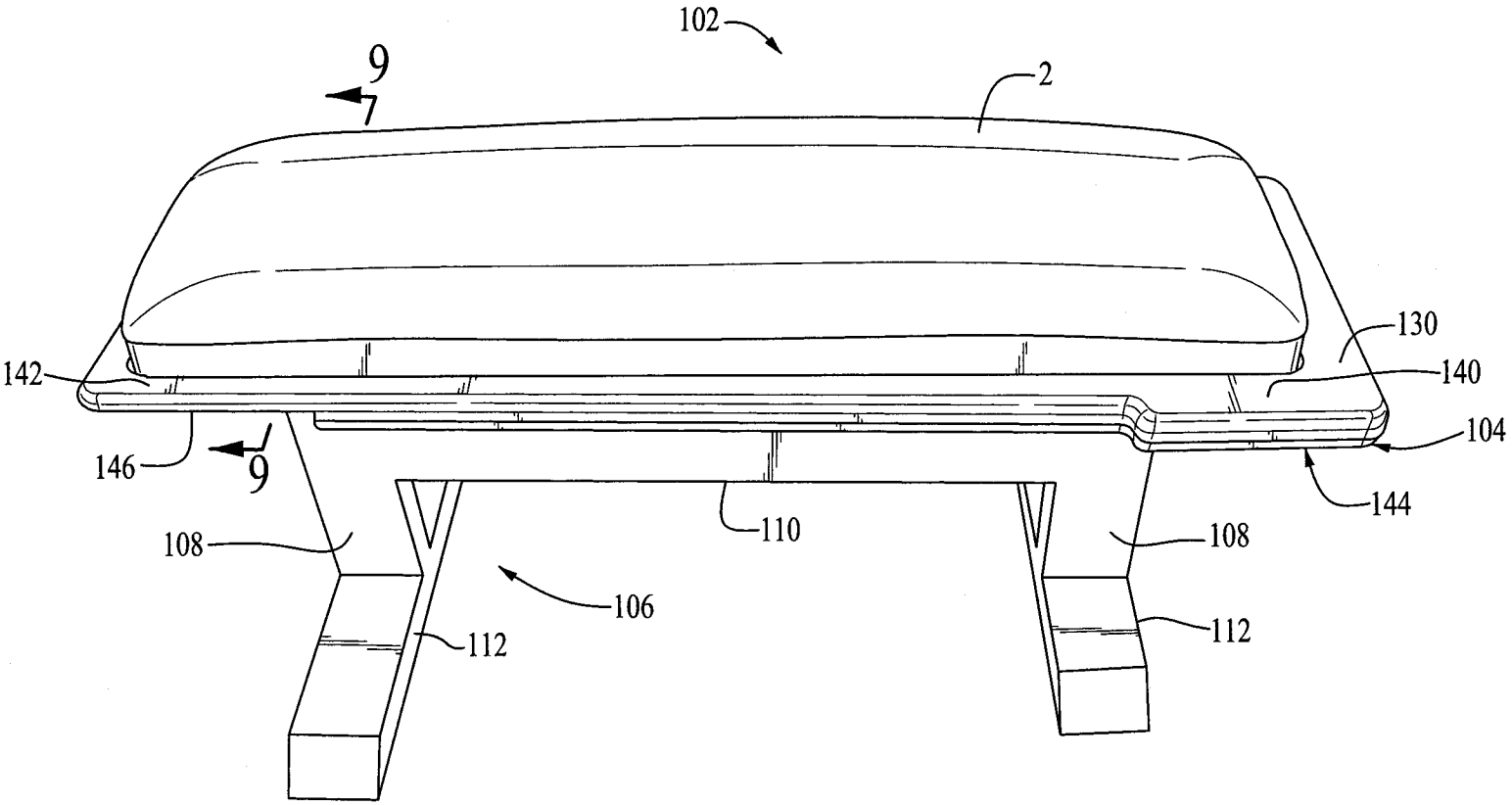
FIG. 9 is a partial sectional view of the apparatus of FIG. 6 taken on line 9-9 in FIG. 6.
Figure 7:
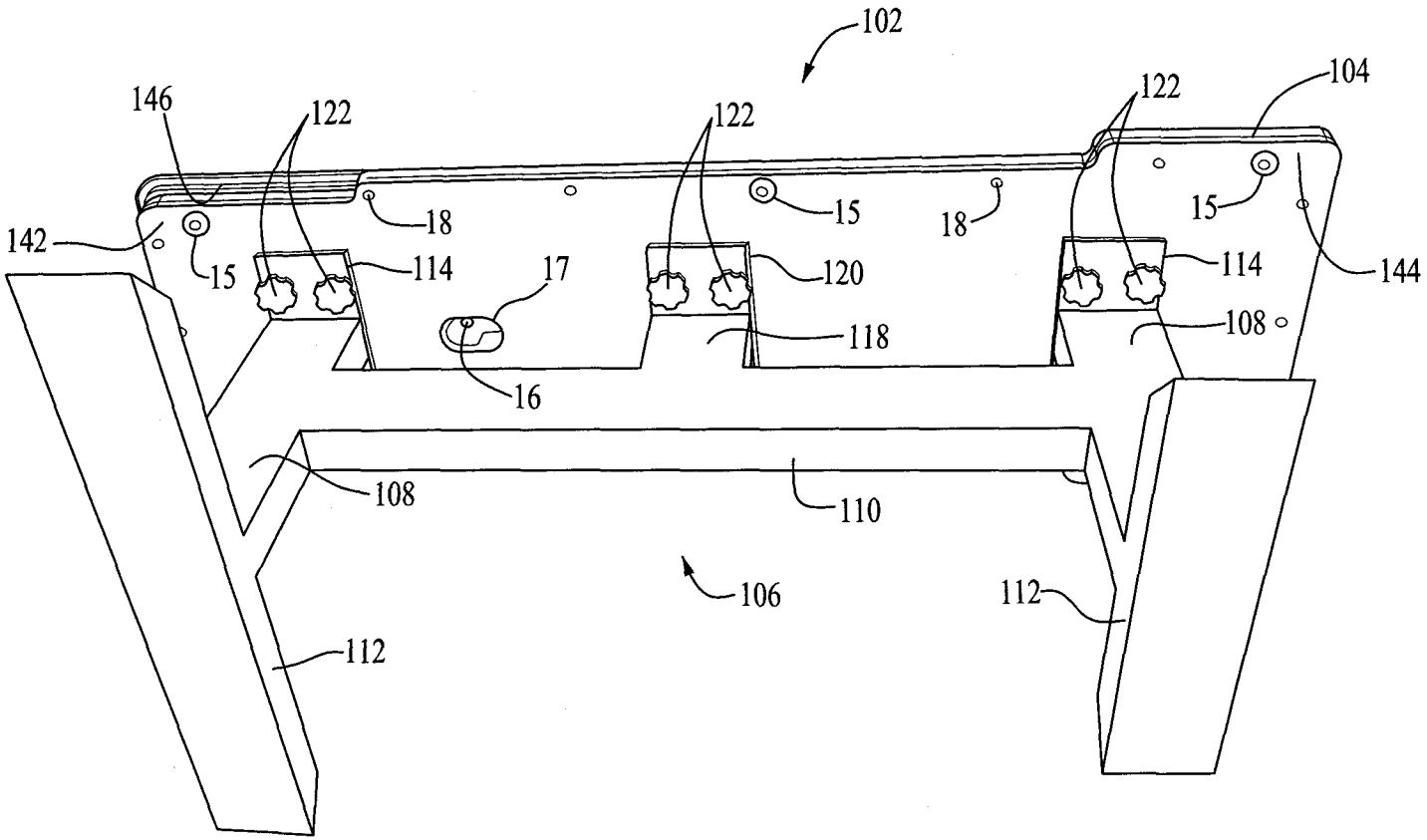
FIG. 7 is a bottom perspective view of the apparatus of FIG. 6.
Figures 8, 8A:
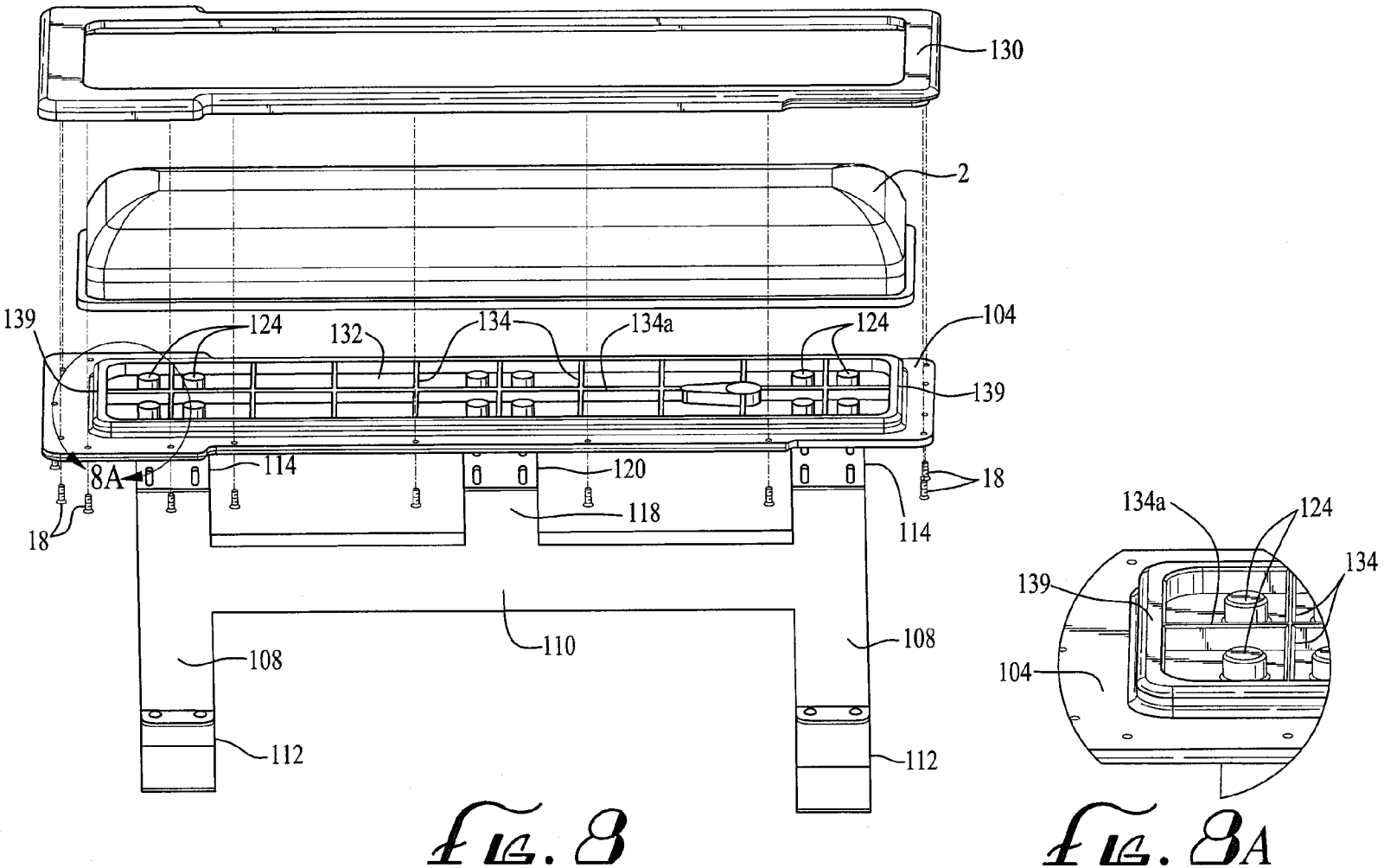
FIG. 8 is an exploded perspective view of the apparatus of FIG. 6.
FIG. 8A is a magnified view of region 8A in FIG. 8.
Figure 9:
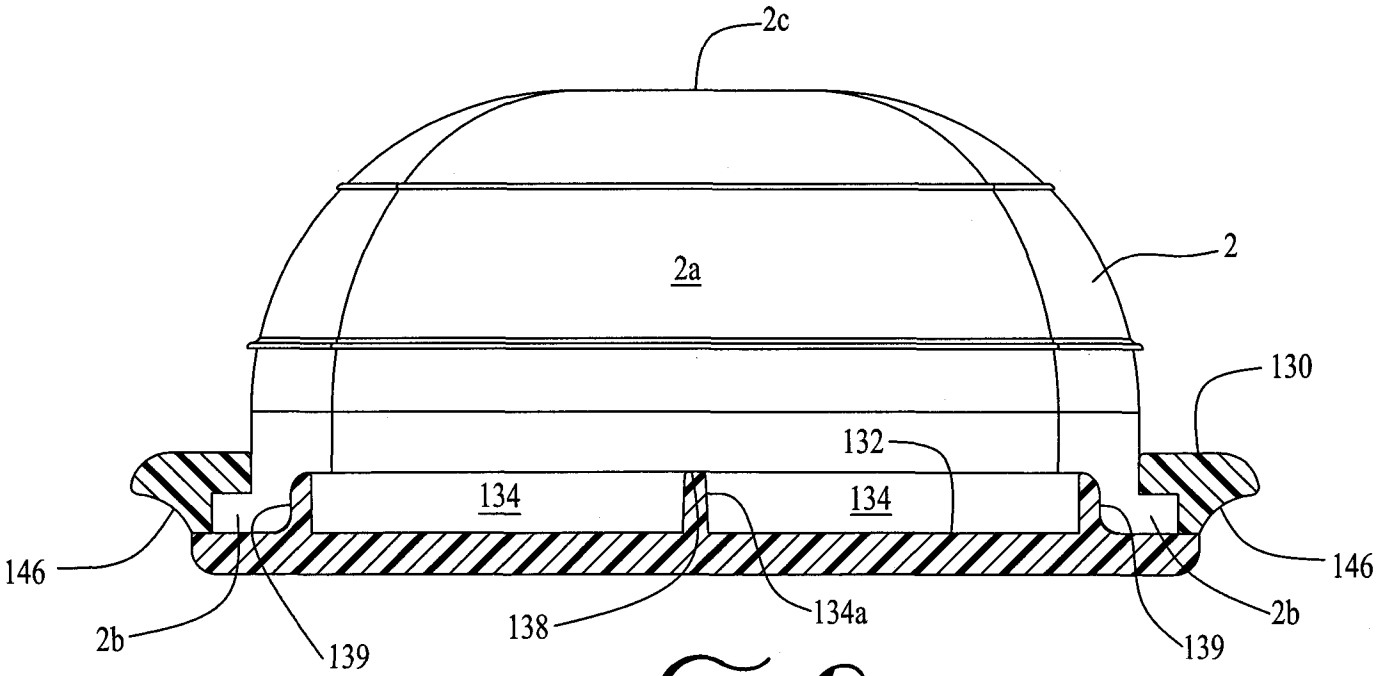

A core section 132 of support 104 can be hollowed out, or completely removed, to reduce weight. Ribs 134 can be provided in a cross pattern to support the cushion (also referred to as a bladder) with even weight distribution. There is an empty space or void between the ribs 134 into which the cushion 2 can expand when weight is placed on the cushion 2. Preferably there is an upwardly projecting longitudinal rib 134*a* that extends down the middle of the support 104, the rib 134*a* projecting into a recess 138 in the cushion body for helping secure the cushion body in position. There is a rim 139 around the hollowed out section 132 fitting into a corresponding recess in the cushion, as shown in FIG. 9, also for holding the cushion 2 in position.

The cushion 2 has a body 2*a* with a dome shaped upper surface, bottom surface, a length and longitudinal axis, and a peripheral rim 2*b* along at least a portion of the edge of the surface of the body 2*a*, and preferably around the entire edge. The apex 2*c* of the upper surface of the body extends along the length of the body parallel to the longitudinal axis of the support 104 for creating instability when exercising.

The retainer 130 is frame shaped, surround the cushion 2, with the peripheral rim 2*b* of the cushion 2 sandwiched between the support 104 and the retainer 130. Fasteners 18 are used to secure the retainer to the support.

The apparatus 102 has a head section 142 and a foot section 144. The support and the retainer 130 provide a foot support 140 on each side of the support at the foot section 144, which comprises a stepped out segment. Also preferably the support has a hand grip 146 on each side of the support at the head section 142. Each hand grip 146 can be an indentation in the underside of the retainer.

Because of the quick release, hand releasable fasteners, the combination of the support cushion, and retainer can be quickly and easily removed from the base for use directly on the ground. By the term "ground" is meant any surface on which the combination can be used, including the outside ground, a mat, or flooring. The bottom of the support can have feet 15 for sitting on a surface.

Preferably the base is made of metal. The retainer and support can be made out of metal or durable plastic or elastomer.

An exercise bench apparatus according to the present invention has many advantages for fitness training. These include:

a) A user's back is supported when laying on the bench, and is allowed to be in a neutral position. This avoids pain and injury to the back. This feature is particularly important for men when doing exercise on the bench, such as bench presses. Men generally have a large trapezoidal area, and on a normal bench, because of this, there is no support for the lower back. With this bench, there is such support.

b) By having essentially the entire torso in a "neutral" position, injury to the spine is prevented.

c) The instability created by the cushion helps strengthen the back, neck and abdominal muscles, particularly the small muscles.

d) The bench helps my clients develop better body balance. This is particularly important for older users, who could suffer hip fractures if they fall.

e) Because the cushion engages substantially the entire torso and causes the entire torso to be engaged when exercising, users achieve "more bang for the buck" when using my bench. For example, a user doing bench presses is not only using the muscles normally engaged when bench pressing, but is also required to maintain balance using core muscles.

f) The bench is easier to get off of than conventional benches. This is important for older users, who can require assistance in dismounting from a bench.

g) The feet support allows a user to get their feet off the ground while exercising on the bench. This is particularly important when doing bench presses in that it helps minimize stress on the lower back.

h) The neck muscles of a user are strengthened using the bench.

While we have shown and described the preferred embodiments of my invention it will be understood the invention may be embodied otherwise then herein specifically illustrated or described, and that certain changes in form and arrangement of parts and the specific manner of practicing the invention may be made within the underlying idea or principles of the invention.

The invention claimed is:

1. An exercise apparatus comprising:

a) a rectangular support and a base for holding the rectangular support above the ground;

b) a single flexible, rectangular gas filled cushion secured to the support, the cushion having a body with a dome-shaped upper surface, a bottom surface, a length, a longitudinal axis, the cushion including a peripheral rim along at least a portion of edge of the bottom surface of the body, wherein the apex of the upper surface of the body extends along the length of the body parallel to the longitudinal axis of the support for creating instability when exercising;

c) a retainer for securing the cushion peripheral rim to the support, wherein the peripheral rim is sandwiched between the support and the retainer; and d) hand releasable fasteners for fastening the support to the base, wherein the hand releasable fasteners can be released without tools for using the cushion without the base.

2. An exercise apparatus comprising:

a) a rectangular support and a base for holding the rectangular support above the ground;

b) a single flexible, rectangular gas filled cushion secured to the support, the cushion having a body with a dome-shaped upper surface, a bottom surface, a length, a longitudinal axis, the cushion including a peripheral rim along at least a portion of edge of the bottom surface of the body, wherein the apex of the upper surface of the body extends along the length of the body parallel to the longitudinal axis of the support for creating instability when exercising;

c) a retainer for securing the cushion peripheral rim to the support, wherein the peripheral rim is sandwiched between the support and the retainer;

d) hand releasable fasteners for fastening the support to the base, wherein the hand releasable fasteners can be released without tools for using the cushion without the base;

e) wherein the base comprises removable legs so that the cushion can be used on the floor;

f) wherein the support comprises at least one upwardly projecting rib and the cushion body includes a recess for receiving the rib; and g) wherein the apparatus has a head section and a foot section, and the support, the retainer, or both have a non-movable foot support on each side of the apparatus at the foot section.

3. An exercise method comprising the steps of:

a) laying prone on a the cushion of the exercise apparatus of claim 1 with the entire weight supported and with the head, neck, and spine held in suspension, wherein the apparatus has opposed sides and a foot section, and further comprising non-movable foot supports sufficiently wide to place feet while exercising on the apparatus, wherein there is a foot support on each side of the apparatus at the foot section;

b) placing feet on the foot supports; and c) moving body muscles.

4. The apparatus of claim 1 wherein the base comprises legs.

5. The apparatus of claim 1 wherein the base is removable from the support so that the apparatus without the base can be used.

6. The apparatus of claim 1 wherein the apparatus has opposed sides and a foot section, wherein the retainer comprises non-movable foot supports sufficiently wide to place feet while working out on the apparatus, wherein there is a foot support on each side of the apparatus at the foot section.

7. The apparatus of claim 1 wherein the base comprises removable legs so that the cushion can be used on the floor.

8. The apparatus of claim 1 or 2 wherein the peripheral rim is along the entire edge of the bottom surface of the cushion.

9. The apparatus of claim 1 or 2 wherein the retainer comprises a frame around the cushion and the peripheral rim of the cushion is held between the frame and the support.

10. The apparatus of claim 1 wherein the support comprises at least one upwardly projecting rib and the cushion body includes a recess for receiving the rib.

11. The apparatus of claim 1 or 2 wherein the support provides space below the cushion for expansion of the cushion into the space when pressure is applied to the top surface of the cushion body.

12. The apparatus of claim 1 having a head section and a foot section, and the support, the retainer, or both have a non-movable foot support on each side of the apparatus at the foot section.

13. The apparatus of claim 12 wherein the support comprises a hand grip on each side of the support at the head section, wherein each hand grip comprises an indentation in the underside of the retainer.

14. The apparatus of claim 1 or 2 having a head section and a foot section, and the support comprises a hand grip on each side of the support at the head section, wherein each hand grips comprises an indentation in the underside of the retainer.

15. The apparatus of claim 1 or 2 comprising only one cushion.

16. A method of exercising comprising the steps of:

a) releasing by hand without tools the combination of the retainer, the support and the cushion from the apparatus of claim 1; and b) after step (a), placing the combination on a floor with the apex of cushion body facing upwardly for exercising on the cushion.

* * * * *